United States Patent [19]

Chao

[11] Patent Number: 4,602,397

[45] Date of Patent: Jul. 29, 1986

[54] WRITING INSTRUMENT

[76] Inventor: Jui H. Chao, 20, Ho Ping Rd., Chiayi City, Taiwan

[21] Appl. No.: 674,147

[22] Filed: Nov. 23, 1984

[51] Int. Cl.[4] ..... B25F 1/10; B25F 11/00; B26B 11/00; B25B 7/22

[52] U.S. Cl. ..... 7/163; 7/132; 7/158; 7/160; 7/164; 7/170

[58] Field of Search ..... 7/129, 130, 131, 132, 7/158, 160, 163, 164, 167, 170; 81/9.1 R

[56] References Cited

U.S. PATENT DOCUMENTS

| | | | |
|---|---|---|---|
| 126,544 | 5/1872 | Heaton | 7/129 |
| 377,974 | 2/1888 | Wheless | 76/88 |
| 589,847 | 6/1897 | Miller | 7/164 |
| 605,674 | 6/1898 | Ingram | 7/170 |
| 2,205,979 | 6/1940 | Horechney | 7/164 |

*Primary Examiner*—Frederick R. Schmidt
*Assistant Examiner*—Bradley I. Vaught
*Attorney, Agent, or Firm*—Sheridan Neimark; Karl W. Flocks

[57] ABSTRACT

An improved writing tool consists essentially of a punctuation marking and error designation rubber seal supplemented by a capping furnished with seal stamping paste; two holes within the body, to permit insertion of a pen or a pencil stick, and a ruler; a clip serving to hold sheet of paper as well as pen holder; a cutter attached to the other side of the clip, serving to cut paper into smaller segments or chips as required. Such a tool proves to be advantageous and convenient in terms of utility, serviceability, endurance and convenience of application.

2 Claims, 2 Drawing Figures

WRITING INSTRUMENT

FIELD OF INVENTION

The present invention relates to a novelly structured, easy to use, highly economical and worthwhile writing instrument which is an improvement over and distinguished from conventional writing instruments or like products.

BACKGROUND OF THE INVENTION

In the world today, among business executives and others working in industrial concerns in particular, speed, economy and reliability are of prime priorities in carrying out assignments to be executed. In many cases, time is money, and many persons make money simply by reason of services rendered, and wasted time cannot be tolerated.

It is beyond doubt that nobody will challenge the stark fact that a writing instrument, a pen or a pencil in particular, structured in a composite form to accommodate other services in addition to writing purposes, is an indispensable tool in daily life, particularly in the office. One can find a variety of writing instruments such as pens, pencils, ball pens and the like in a stationery shop anywhere, each model being presented to cater to the consumer's needs or with emphasis placed predominantly on the appearance or embellishing trimming effects, but which much too often prove of little practical advantage to the use thereof, especially as regards writing performance or ease of disposition. Writing instruments as manufactured by the industry still remain inadequate and this state rightly accounts for the objective of the revolutionary breakthrough in execution that will combine both ease of writing and ease of disposition in one composite embodiment.

SUMMARY OF THE INVENTION

The present invention comes about virtually as a result of numerous trials and experiments dedicated to bring into being a truly worthwhile improvement over conventional like products available anywhere.

So the primary objective of the present invention is to provide a novelly structured, highly effective, economically worthwhile structure of an improved writing instrument, tested to be far more advantageous than a conventional instrument in regard to writing performance or ease of disposition and readiness to serve a writing purpose.

A further objective of the present invention is to provide an improved writing instrument, having a stress marking and error designation rubber seal provided on the top thereof, as well as a seal stamping paste retaining capping attached to the outside of the said rubber seal to facilitate making purposes where necessary as well, thereby making writing an easy and carefree job anytime anywhere.

A further objective of the present invention is to provide an improved writing instrument having two penetration holes provided within to permit insertion of a writing element which can be a pen, a pencil stick, or the like, serving an ordinary, regular writing purpose like drawing a line segment, making measurements, or writing of words, or drawing a picture or a portrait.

A further objective of the present invention is to provide an improved writing instrument having a clip provided down the body, serving to hold, to cut paper or sheets of document and hold the pen holder in position.

DESCRIPTION OF THE DRAWINGS

Other features and advantages of the present invention will emerge from the following descriptions of embodiments given by way of illustration but not in any way limiting, with reference to the accompanying drawings in which.

DETAILED DESCRIPTION OF THE INVENTION

Figure 1:
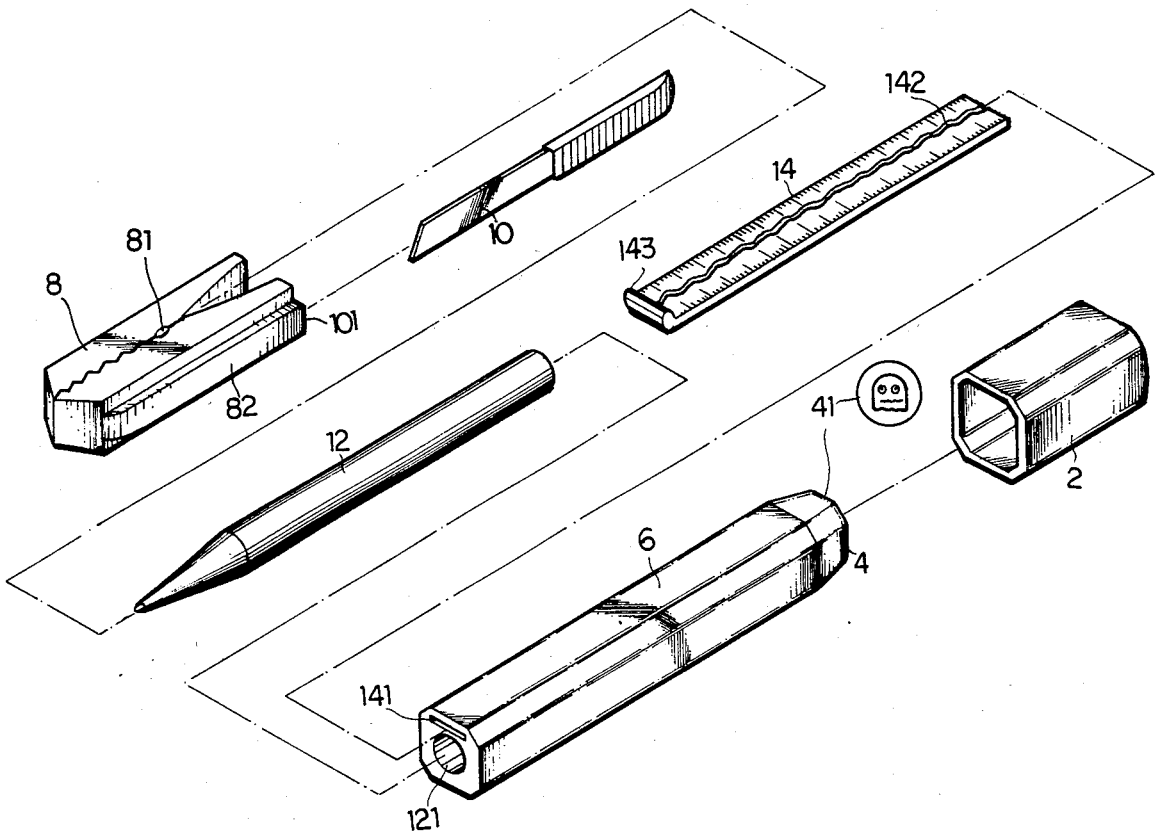
FIG. 1 is a three-dimensional, exploded perspective view of a device of the invention.

Referring to FIG. 1, it will be seen that the present invention is composed essentially of a capping 2, a rubber seal 4, the body 6, a clip 8, a cutter 10, the pencil stick 12, and a ruler 14; the top of the body 6 is provided with a rubber seal 4 having a pattern 41 provided on the surface thereof to serve to designate an error made in the writing process and to mark where a marking is desired on a document of any kind that is involved as well. To insure that the rubber seal 4 will suffice in use, a capping 2 is provided on top of the rubber seal 4 relative to the body 6, with a stamp paste provided therewithin to facilitate impressing of the rubber seal 4 thereto for imprinting the pattern 41 of the seal where desired.

In the body 6 there are provided two penetration holes 121, 141; hole 121 serves to stabilize and partly retain the pen or pencil stick 12 inserted within the body 6, whereas hole 141 serves to permit insertion of ruler 14. On the surface of the ruler 14 there are provided wavelike grooves 142 to facilitate drawing of line segments. On one end of the ruler 13 is provided a flange 143 to serve to hold the ruler 14 stopped by the end of the penetration hole 131 as the ruler 13 is inserted into the hole 131, so that the ruler 14 is prevented from falling entirely into the hole 141, thereby assuring ease of use of the present device.

Down the body 6 is provided a clip 8 serving to fasten sheets of paper as well as the pen holder. The clip 8, by means of a spring 81 provided therewith, will function as a conventional book clip, typically in order to hold a number of pages fixed from casual displacement in cases where it is meant to do so. On one side of the clip 8 is provided a part of a pen holder 82 serving to hold the assembled device in position, typically in a shirt pocket or elsewhere where appropriate. On one end of the pen holder 82 is provided a tool rest recess 101, serving to hold a cutter 10 which can be used to cut an envelope to open same, and thus the holder end of the cutter 10 completes the pen holder when the cutter blade is retained in the recess 101.

Figure 2:
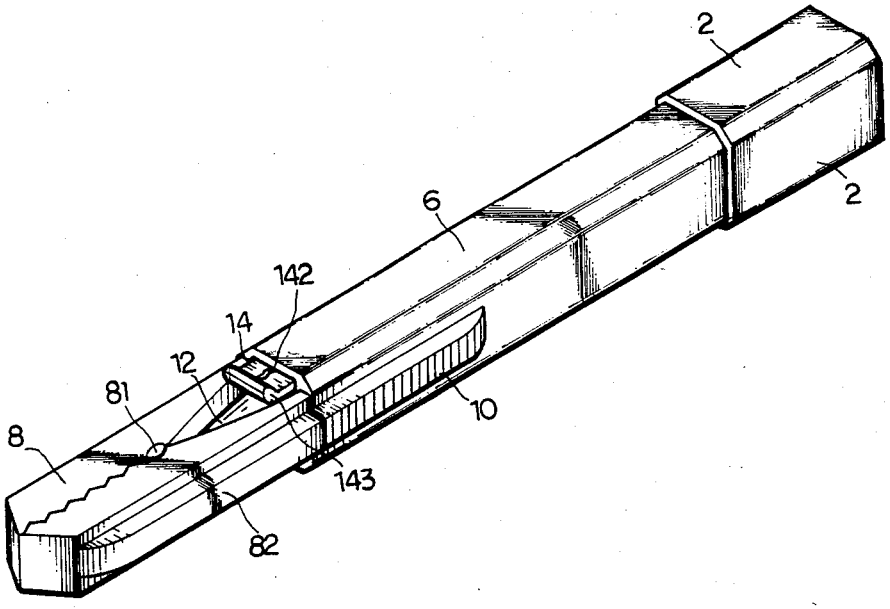
FIG. 2 is a three-dimensional perspective of the device of FIG. 1 assembled.

Referring to FIG. 2, it will be seen that to use an improved writing instrument structured hereunder, one just puts the pen 12 and the ruler 14 into the penetration holes 121, 131 for the body 6, and attaches the clip 8 to the underside of the body 6, the cutter 10 being left inserted into the cutter recess 101 relative to the pen holder 82 relative to the clip 8, the capping 2 (within which the stamp paste is contained) set into the top end of the body 6 where the rubber seal 4 is attached thereto, thereby preventing drying out of the seal stamp paste while serving to protect the rubber seal 4 and adding an embellished appearance of the whole device at large. When the ink in the pen stick 12 is used up, the pen stick 12 can be renewed by replacement or by refilling of ink as appropriate according to the particular type of pen involved, and the device is retained for continued service, so it becomes obvious at once that the tool of the present invention is truly an extremely useful and convenient tool provided with supplementary functions defying imitation by any other known products available anywhere in the market; and therefore the invention has clear absolute advantages in the world today where everybody is so busy.

The disclosure going thus far should appear sufficient to claim it to be a truly worthwhile piece of invention by virtue of the achievements to make possible the integration of all parts thereof in the body without requiring additional space whatever, to serve additional purposes in addition to a writing purpose, such as those defined in the foregoing descriptions.

I claim:

1. Improved writing instrument, comprising essentially a capping, a body, a clip, a cutter, and a ruler, characterized in the provision of a rubber seal on top of the body, and that the capping having stamping paste contained therewithin is provided by attachment to the outside of the rubber seal relative to the upper section of the body, that two penetration holes are provided in the body to permit insertion of a pen stick and the ruler, that the clip is provided to extend from the body, said instrument serving to cut sheets of paper by means of said cutter in addition to clipping pages of a book by means of said clip, a pen holder on one side of the clip, and a cutter recess on one end of the pen holder to lock the cutter when established therein.

2. A writing tool comprising an elongated body with first and second ends and having a first hole at said first end for removably receiving therewithin a writing element, and a slot at said first end for removably receiving therewithin a ruler; a ruler for removably positioning within the slot of said body portion; a rubber stamp at the second end of said body portion; a cap containing stamping paste and removably covering said second end of the body portion; a removable clip means extending from the first end of said body portion for clipping pages of a book; a pen holder part on one side of the clip, said pen holder part having a slot therein for removably receiving a cutter blade; and a cutter having a blade portion and a handle portion, said blade portion removably fitting within the recess of said pen holder part.

* * * * *